US009352379B2

(12) United States Patent
Gogola

(10) Patent No.: US 9,352,379 B2
(45) Date of Patent: May 31, 2016

(54) TOOLING POD FOR DOUBLE ACTION CAN END PRESS

(75) Inventor: Michael R. Gogola, Itasca, IL (US)

(73) Assignee: Rexam Beverage Can Company, Chicago, IL (US)

( * ) Notice: Subject to any disclaimer, the term of this patent is extended or adjusted under 35 U.S.C. 154(b) by 966 days.

(21) Appl. No.: 12/419,692

(22) Filed: Apr. 7, 2009

(65) Prior Publication Data

US 2010/0251799 A1 Oct. 7, 2010

(51) Int. Cl.

| | |
|---|---|
| ***B21D 51/44*** | (2006.01) |
| ***B21D 22/22*** | (2006.01) |
| ***B21D 22/24*** | (2006.01) |
| ***B21D 37/14*** | (2006.01) |

(52) U.S. Cl.

CPC ..... *B21D 51/44* (2013.01); *B21D 22/22* (2013.01); *B21D 22/24* (2013.01); *B21D 37/14* (2013.01)

(58) Field of Classification Search

CPC ..... B21D 35/00; B21D 28/06; B21D 22/20–24/16; B21D 22/00–22/08

USPC ..... 72/329, 335, 336, 347, 350; 413/8, 56

See application file for complete search history.

(56) References Cited

U.S. PATENT DOCUMENTS

| | | | | |
|---|---|---|---|---|
| 2,884,886 A | | 5/1959 | Jonsson | |
| 4,442,691 A | * | 4/1984 | Grow et al. | 72/329 |
| 4,554,814 A | * | 11/1985 | Grow et al. | 70/345 |
| 4,567,746 A | * | 2/1986 | Bachmann et al. | 72/348 |
| 4,571,978 A | * | 2/1986 | Taube et al. | 72/349 |
| 4,574,608 A | * | 3/1986 | Bulso et al. | 72/348 |
| 4,615,204 A | | 10/1986 | Yamamoto et al. | |
| 4,620,434 A | | 11/1986 | Pulciano et al. | |
| 4,716,755 A | * | 1/1988 | Bulso et al. | 72/349 |
| 4,722,215 A | * | 2/1988 | Taube et al. | 72/349 |
| 4,800,743 A | * | 1/1989 | Bulso et al. | 72/336 |
| 4,808,052 A | * | 2/1989 | Bulso et al. | 413/8 |
| 4,865,506 A | * | 9/1989 | Kaminski | 413/56 |
| 4,977,772 A | | 12/1990 | Bulso, Jr. et al. | |

(Continued)

FOREIGN PATENT DOCUMENTS

JP 59047028 3/1984

OTHER PUBLICATIONS

Rexam Beverage Can Company, International Search Report from co-pending PCT/US2010/030239, mailed Jul. 20, 2010 from the European Patent Office.

*Primary Examiner* — David Bryant
*Assistant Examiner* — Lawrence Averick
(74) *Attorney, Agent, or Firm* — Greer, Burns & Crain Ltd.

(57) ABSTRACT

A double action press for forming a beverage can lid has a longitudinal axis, an inner tooling, and an outer tooling. The inner tooling is positioned about the longitudinal axis and has a downwardly extending stem. The stem has an upper segment having a free end and a separate lower segment having a proximal end. The proximal end is in communication with, but is not joined to, the lower free end of the upper segment. An opposing distal end is joined to a punch core. The outer tooling is positioned about the longitudinal axis and has a passageway through which a portion of the stem passes, a chamber in which the proximal end of the lower segment of the stem resides and traverses upwardly and downwardly therein, a biasing means within the chamber for biasing the lower segment of the stem in an upward position, and a circumferential tooling assembly.

4 Claims, 7 Drawing Sheets

(56) References Cited

U.S. PATENT DOCUMENTS

| | | | | |
|---|---|---|---|---|
| 5,046,637 | A * | 9/1991 | Kysh | 220/610 |
| 5,272,902 | A * | 12/1993 | Kobak | 72/348 |
| 5,626,048 | A | 5/1997 | McClung | |
| 6,032,505 | A * | 3/2000 | Stodd | 72/336 |
| 6,490,904 | B1 * | 12/2002 | Zauhar | 72/348 |
| 7,007,535 | B2 * | 3/2006 | McClung | 72/351 |
| 7,124,613 | B1 * | 10/2006 | McClung | 72/348 |
| 7,240,531 | B2 * | 7/2007 | Turnbull et al. | 72/348 |
| 7,302,822 | B1 * | 12/2007 | Turnbull et al. | 72/348 |
| 7,305,861 | B2 * | 12/2007 | Turner et al. | 72/348 |
| 7,350,392 | B2 * | 4/2008 | Turner et al. | 72/379.4 |
| 7,464,576 | B2 * | 12/2008 | Turner et al. | 72/350 |
| 7,478,550 | B2 * | 1/2009 | Wynn et al. | 72/348 |
| 7,513,138 | B2 * | 4/2009 | Turner et al. | 72/348 |
| 2005/0006388 | A1 * | 1/2005 | Turner et al. | 220/269 |
| 2006/0096994 | A1 | 5/2006 | Turner et al. | |
| 2007/0283738 | A1 * | 12/2007 | Turnbull et al. | 72/348 |
| 2008/0025820 | A1 * | 1/2008 | Turner et al. | 413/8 |
| 2008/0083255 | A1 * | 4/2008 | Turner et al. | 72/347 |
| 2008/0087067 | A1 * | 4/2008 | Holmes | 72/348 |
| 2008/0098789 | A1 * | 5/2008 | Hori et al. | 72/349 |
| 2009/0266824 | A1 * | 10/2009 | Turner et al. | 220/600 |
| 2009/0269169 | A1 * | 10/2009 | Turner et al. | 413/1 |
| 2010/0251799 | A1 * | 10/2010 | Gogola | 72/384 |
| 2011/0033265 | A1 * | 2/2011 | Gogola et al. | 413/31 |

* cited by examiner

TOOLING POD FOR DOUBLE ACTION CAN END PRESS

CROSS-REFERENCE TO RELATED APPLICATIONS

N/A

FEDERALLY SPONSORED RESEARCH OR DEVELOPMENT

N/A

TECHNICAL FIELD

The invention relates to can end manufacturing. More particularly, the invention relates to a double action press having a removable tooling pod for manufacturing can ends.

BACKGROUND OF THE INVENTION

Common easy open end closures for beer and beverage containers have a central or center panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin sheet of aluminum or steel. End closures for such containers are also typically constructed from a cut-edge of thin sheet of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

One goal of the can end manufacturers is to provide a buckle resistant end. U.S. Pat. No. 7,350,392 and its related patents, publications, and pending applications describe a method aimed at improving the buckle strength of a can end having a seaming curl, a chuck wall. The method includes forming a fold along at least substantially the entire length of the chuck wall.

Some time ago, the art adopted a two-stage type of system for manufacturing can ends. The system uses a shell press that forms shells from a coil of stock material, and one or more end conversion presses that converts the shell into a finished end.

The presses known in the art generally fall into one of two categories: single action and double action presses. Single action presses use a single driving mechanism (ram device) to move the upper tool. Double action presses use two driving rams, an inner ram and an outer ram. Double action presses are considerably more complex and costly machines and are more expensive to maintain and operate.

Double action presses are described in, for example, U.S. Pat. No. 4,977,772 and U.S. Pat. No. 5,626,048, both of which are hereby incorporated by reference as if fully set forth herein. Typically, the upper portion of a double action tooling presses such as the one illustrated in FIG. 3 of the '772 patent, include an inner slide holder and an outer slide holder. The inner slide holder carries a stem secured thereto by one or more bolts. The projecting end of the stem carries a punch core secured thereto in adjustable fashion by the screw. In this fashion, the tooling such as punch core can be moved toward and away from the fixed base of the press as inner slide holder moves toward and away from the base.

The outer slide holder has an appropriate hollow cavity within which the stem and punch core of the inner slide holder reciprocate substantially independently of the movement of the outer slide holder.

This outer slide holder also carries with it certain tooling. First, radially inwardly is a sleeve secured thereto by retainer and screws so as to be reciprocal therewith. Radially outwardly of the sleeve and in concentric surrounding relationship therewith is a first pressure sleeve and a fluid actuated piston which acts thereon. Secured to the projecting bottom end of the outer punch holder is a cut edge which is secured by one or more screws.

The fluid actuated piston is carried by outer slide holder above first pressure sleeve and is controlled by fluid introduced through bore and vented through bore with bore being connected to a suitable source of fluid supply (not shown).

The outer slide holder will be moved to the down position and fluid pressure exerted on the piston through bore will force the first pressure sleeve into holding relationship with the material. Further downward movement of outer slide holder will cause the cut edge to blank the material against cut edge. In that regard, cut edge is carried on die holder and does not move. Stock plate is fluidly supported. Therefore, downward movement of cut edge will depress stock plate a sufficient distance to permit the blanking operation to take place.

Continued downward movement of the inner slide holder forces the punch core downwardly against the previously blanked material, pulling it out of its previously clamped position beneath sleeve and forming it into a shallow cup. The inner ram continues downwardly, while the outer slide holder is retracting.

As stated above, double action presses of this type are expensive to maintain and operate. Generally, the tooling in a double action press is difficult to access. This makes it difficult to align and guide the tooling.

Tramming the press is often difficult on a double action can end press. The upper tooling must be trammed to the lower tooling which is separated by the foot long stem.

There are also tooling wear issues in a double action press caused by galling. Galling occurs when there is contact between two tools, and a dull wear pattern develops on one or both tools. Galling can cause enough wear of the surface of a tool to the point where friction is created, and the tools seize up, restricting or eliminating tool movement.

There are also a great number of seals needed to operate a double action can end press. A large number of seals will create heat due to friction during operation. The excessive heat often causes tool control and guidance issues. When the tools fall out of alignment, the press will shear the cut edge of the metal stock. Shearing of the cut edge leads to defects in the seaming curl of the can end or in the later seaming process when the can end is seamed (attached) to a filled can body.

The present invention is provided to solve the problems discussed above and other problems, and to provide advantages and aspects not provided by prior double action can end presses of this type. A full discussion of the features and advantages of the present invention is deferred to the following detailed description, which proceeds with reference to the accompanying drawings.

SUMMARY OF THE INVENTION

One aspect of the present invention is directed to a double action tooling press apparatus for forming a beverage can lid. The apparatus comprises a longitudinal axis, an inner tooling assembly, and an outer tooling assembly. The inner tooling assembly is positioned about the longitudinal axis and comprises a downwardly extending stem having an upper segment with a lower free end and a lower segment having a proximal end in operative communication with, but not joined to, the lower free end of the upper segment and an opposing distal end joined to a punch core tool. The outer tooling assembly is positioned about the longitudinal axis and has a passageway through which a portion of the stem passes and a circumferential tooling set encircling the lower segment of the stem. In this aspect of the invention the lower segment of the stem and the punch core tool form a removable tooling pod with the circumferential tooling set of the outer tooling assembly and wherein the tooling pod is removable from the apparatus as a single unit.

This aspect may further comprise an inner tooling assembly drive mechanism in operative communication with the inner tooling tooling assembly for imparting a downward force to thereto. An outer tooling assembly drive mechanism may be in operative communication with the outer tooling assembly and independent of inner tooling drive mechanism. A biasing means may be in engagement with the lower segment of the stem wherein the biasing means biases the lower segment of the stem in an upward position. A contact pad may be attached to the free end of the upper segment of the stem. An engagement surface may be within the passageway against which the biasing means is engaged to bias the lower segment of the stem in the upward position. The engagement surface is defined by a region of the passageway between a first section of the passageway having a greater cross-sectional area than a second section of the passageway located directly below the first section of the passageway.

Another aspect of the present invention is directed to a tooling pod for a double action press for forming a beverage can lid. The double action tooling press has a radially inner tooling assembly and a radially outer tooling assembly independent of the radially inner tooling assembly wherein the radially inner tooling includes a stem having a free end extending downwardly and through a passageway in the radially outer tooling. The tooling pod comprises a circumferential tooling, a riser, and a punch core tool. The circumferential tooling is attached to the outer tooling assembly and comprises a first cylindrical tool. The riser has a proximal end separate from, but in operative communication with, the free end of the stem of the radially outer tooling and a distal end. The punch core tool is attached to the distal end of the riser and encircled by the first cylindrical tool. In this aspect of the invention, the circumferential tooling, the riser, and the punch core tool form a removable tooling package which can be inserted and removed from the double action press as a unitary member.

This aspect of the invention may further comprise a second cylindrical tool located radially inwardly of the first cylindrical tool and radially outwardly of the punch core wherein the second cylindrical tool forms part of the unitary member removable from the double action press. A third cylindrical tool may be located radially inwardly of the second cylindrical tool and radially outwardly of the punch core wherein the third cylindrical tool forms part of the unitary member removable from the double action press. A biasing means may be attached to the proximal end of the riser wherein the biasing member forms part of the unitary member removable from the double action press Another aspect of the present invention is directed to a double action press for forming a beverage can lid. The apparatus comprises a longitudinal axis, an inner tooling assembly, and an outer tooling assembly. The inner tooling assembly is positioned about the longitudinal axis and comprises a downwardly extending stem having an upper segment with a free end and a separate lower segment having a proximal end in operative communication with, but not joined to, the lower free end of the upper segment and an opposing distal end joined to a punch core tool. The outer tooling assembly is positioned about the longitudinal axis and has a passageway through which a portion of the stem passes, a chamber in which the proximal end of the lower segment of the stem resides and traverses upwardly and downwardly therein, a biasing means within the chamber for biasing the lower segment of the stem in an upward position, and a circumferential tooling set. The circumferential tooling set comprises a first tool having an annular contacting surface and a void defined by an elongated circumferential sidewall, an upper pressure sleeve located radially inwardly of the annular contacting surface of the blank punch and within the void defined by the inner surface of the elongated circumferential sidewall of the blank punch, and a second tool within the upper pressure sleeve and encircling the punch core tool.

This aspect of the invention may further comprise an inner tooling assembly drive mechanism in operative communication with the inner tooling assembly for imparting a downward force to thereto. An outer tooling assembly drive mechanism may be in operative communication with the outer tooling assembly and independent of inner tooling drive mechanism. The lower segment of the stem and the punch core tool may form a removable tooling pod with the circumferential tooling set of the outer tooling assembly, and the tooling pod may be removable from the apparatus as a single unit.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
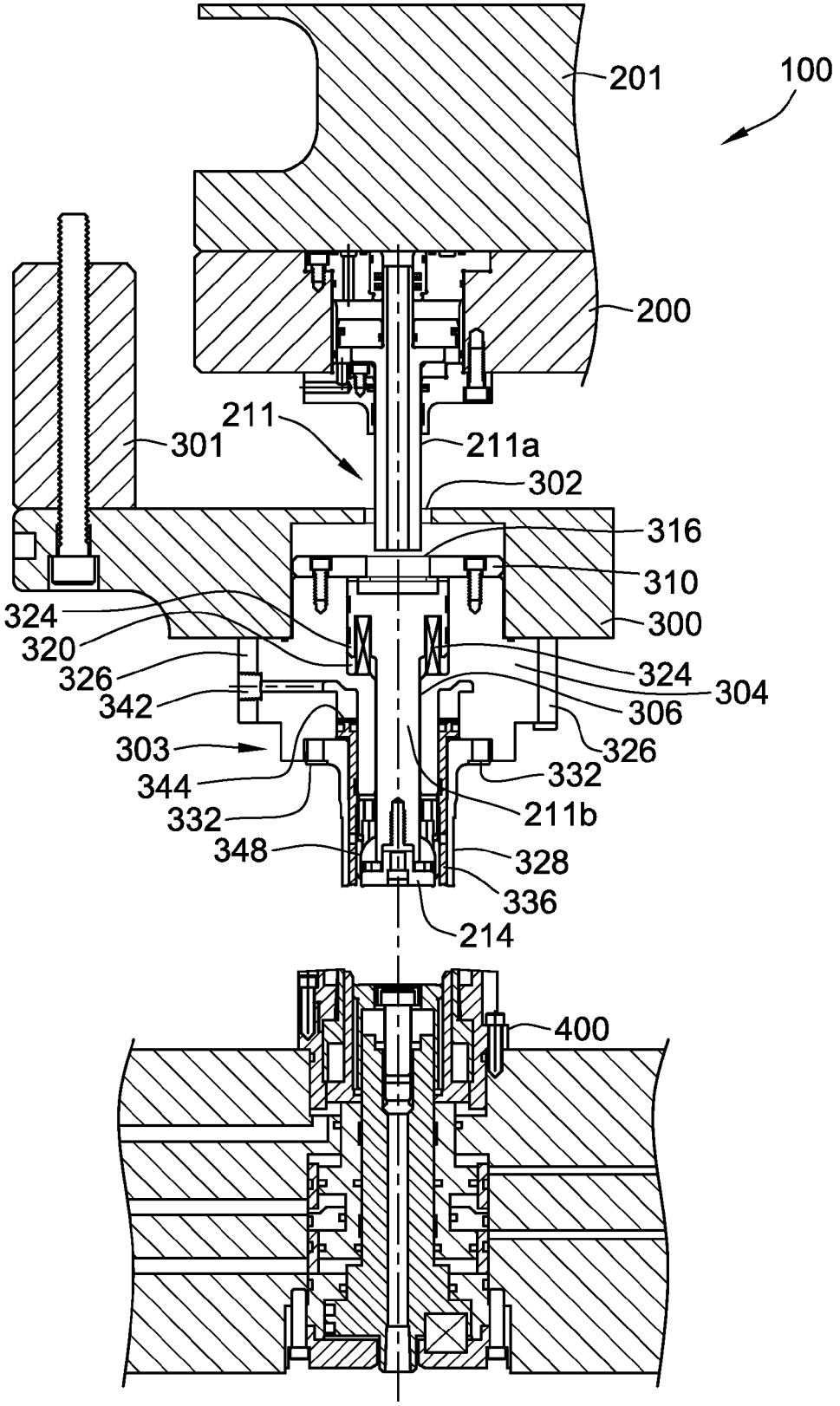
FIG. 1 is an elevational view of a double action press of the present invention in a retracted position.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
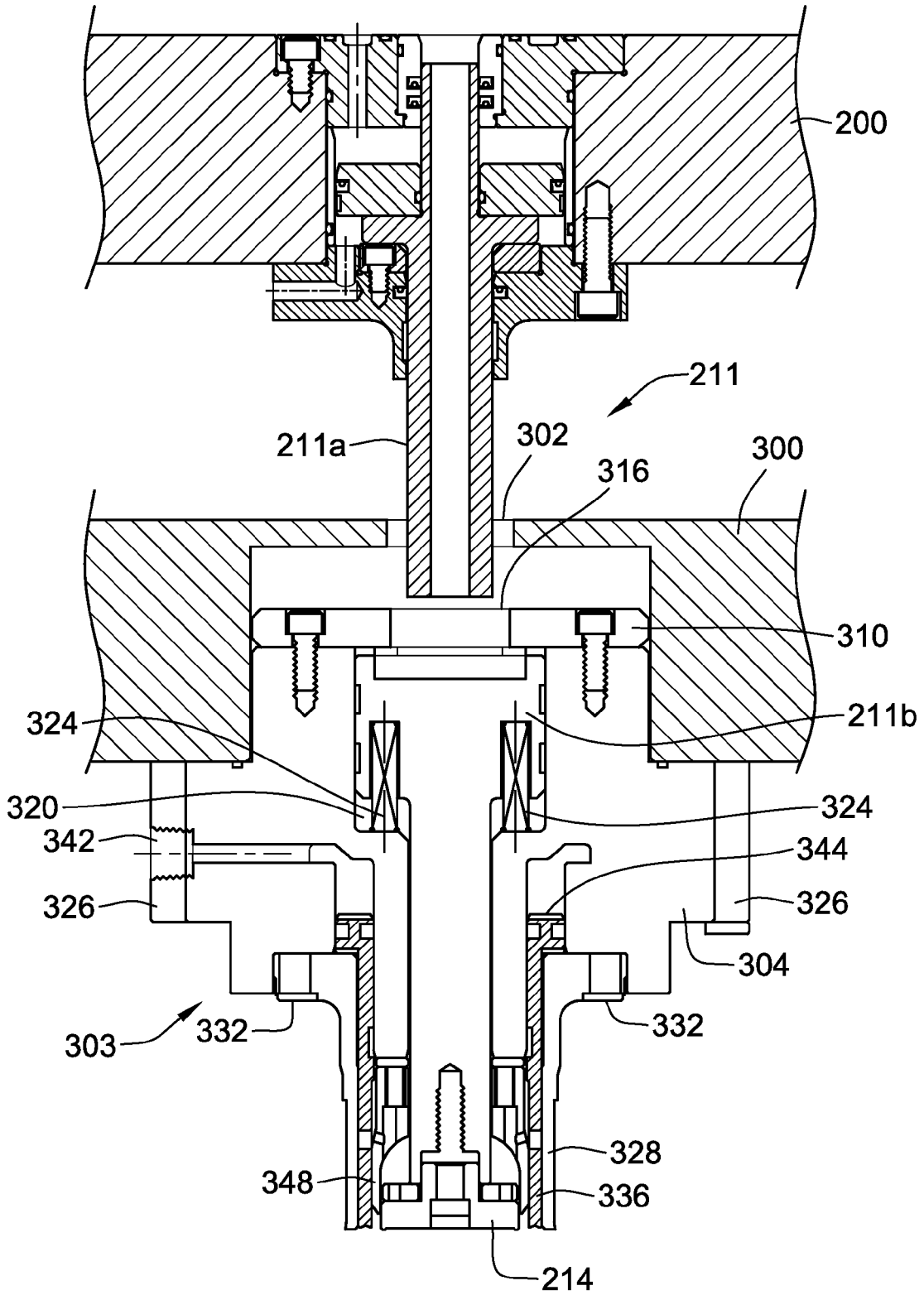
FIG. 2 is a partial elevational view of the double action press of FIG. 1 showing only the portion of the press above the plane on which sheet metal is introduced into the apparatus for forming.
Figure 3:
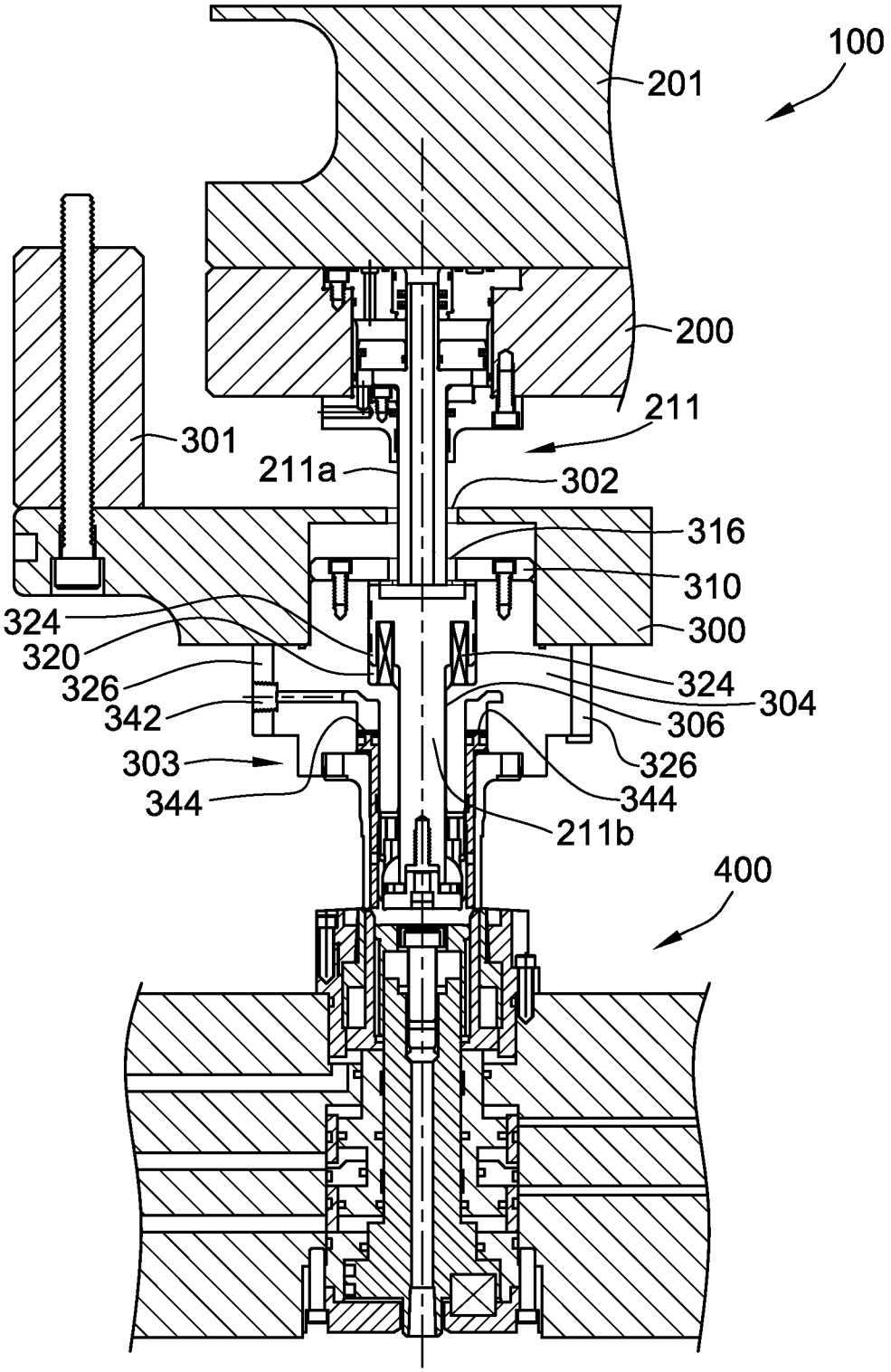
FIG. 3 is an elevational view of the double action press of FIG. 1 in a partially extended position.

Referring to FIGS. 1-3, a double action press 100 for forming can ends is illustrated. The press comprises an inner tooling assembly including an inner slide holder 200 also called an inner die shoe and an outer tooling assembly including an outer slide holder 300 also called an outer die shoe. The inner and outer tooling assemblies include separate drive mechanisms 201, 301 for transferring downward movement to the respective assemblies, also called a downstroke. During the downstroke, portions of the inner and outer tooling assemblies, together forming an upper tooling assembly, cooperate with a lower tooling assembly 400 to form a can end shell. This type of tooling layout is generally provided on Minster DAS-H200 Double Action Press.

The inner die shoe 200 is generally positioned about a longitudinal axis, which may typically be a vertical axis defining a center line of the apparatus. The inner die shoe 200 carries a stem 211. The stem 211 extends downwardly from the inner die shoe 200 into the outer dies shoe 300. The stem 211 of the present apparatus is segmented into an upper portion or segment 211*a* also called an inner punch core riser, and a lower portion or segment 211*b*. A first or proximal end of the upper segment 211*a* is housed within an upper chamber and retained therein by one or more bolts. A second end of the upper segment 211*a* is a free end. The free end is not joined to the lower segment 211*b*. Instead, the free end may be in operative communication or engagement with the lower segment 211*b* during a downstroke of the apparatus 100.

The lower segment 211*b* includes an upper or proximal end, also a free end, and an opposing lower end forming a distal end of the stem. The lower segment 211*b* is also referred to as an outer punch core riser because it is located within the outer tooling assembly. The upper end includes a dampening ring for selective engagement with the free end of the upper segment 211*a* during the downstroke.

The lower segment 211*b* is housed within the outer die shoe 300, and may be entirely housed within the outer die shoe such that no portion of the lower segment protrudes outwardly therefrom. Accordingly, the outer die shoe 300 includes a first aperture 302 at an upper end through which the upper segment 211*a* of the stem passes to operatively engage the lower segment 211*b* of the stem 211.

The lower segment 211*b* may be at least partially retained within a passageway 306 in the outer die shoe 300 by a retaining member 310 fixed to a portion of the outer die shoe 300 by bolts. The retaining member 310 may generally be a plate having an aperture 316 though which a portion of the stem 211 passes. Preferably, the lower segment 211*b* of the stem 211 is completely within the passageway 306, and the free end of the upper segment 211*a* passes through the first and second apertures 302, 316 to engage the lower segment 211*b* during the downstroke.

An intermediate portion of the lower segment 211*b* of the stem 211 is slightly wider than an adjacent portion of the lower segment 211*b*. In other words, the intermediate portion has a greater cross-sectional area than the adjacent portion of the lower segment 211*b*. This intermediate section resides in an enlarged chamber 320 of the passageway 306 capped by the retainer 310. Biasing members such as springs 324 are located within the chamber 320 and bias the lower segment 211*b* upwardly within the chamber 320 towards the retainer 310. The retaining member 310 prevents the intermediate section from over-travel in the upward direction or towards the inner die shoe 200.

Opposite the retainer 310, the chamber 320 terminates into a portion of the passageway 306 having a smaller cross-sectional area than the chamber 320. This termination zone acts as a stop to prevent the stem 211 from over-travel as the intermediate section traverses downwardly within the chamber 320.

The distal end of the stem 211 carries a punch core tool 214. The punch core tool 214 is removably attached to the stem 211 by one or more bolts.

Like the inner die shoe 200, the outer die shoe 300 is generally positioned about the longitudinal axis. The outer die shoe includes a tooling pod 303 which will be explained in more detail below.

Unlike all known can end making double action presses, the outer die shoe 300 carries with it a selectively removable tooling pod 303. The tooling pod 303 includes a main pod body 304 fixedly attached to the outer die shoe 300 by one or more bolts 326. The main pod body includes the passageway 306 which houses the lower segment 211*b* of the stem 211. Thus, a portion of the inner tooling assembly, the lower segment 211*b* of the stem 211 and the punch core tool 214, is removable with the tooling pod 303. This radical departure from the double action tooling presses known in the art has great advantages over prior art double action tooling presses of this type.

For instance, the apparatus of the present invention is less expensive to maintain and operate because access to the majority of the tooling has been simplified. This makes the apparatus 100 and the tooling easier to align and guide. Tramming is simplified because the upper or outer tooling is no longer separated from the lower or inner tooling by the full length of the stem 211 which measures 12 inches (30.4 cm) or more in length. Because tramming is simplified and improved, less galling of the tools will occur. Thus, tooling wear issues improve. The apparatus 100 will also have less of a tendency to seize because friction between the tools is reduced. Furthermore, the use of the tooling pod 303 reduces the number of seals required between moving parts. This reduces heat generated by the apparatus 100 during use which reduces tool control and guidance issues. All of this leads to improved productivity and adherence to tighter tolerances because the tools will not fall out of alignment due to heat, galling, poor tram, etc., and the press will shear the cut edge of the metal stock cleanly. Improper shearing caused by reduced clearance between the tooling leads to cut edge defects. These defects can cause poor quality in the seaming curl of the can end or in the later seaming process when the can end is seamed (attached) to a filled can body, or, in extreme cases, poor shearing can cause the apparatus 100 to fail.

Further to the reduction in seals, in a prior art outer die shoe for a double action press, there are typically nine (9) seals and six (6) O-rings. The vertical travel of the piston in the prior art double action press is on the order of 0.726 inches (18.4 mm). Implementing the tooling pod 303 described herein reduces the vertical travel of the piston to 0.356 inches (9.04 mm).

A substantially cylindrical circumferential punch shell or sleeve 328 may be fixedly attached to the outer tooling assembly, preferably the main pod body 304 such that the punch shell 328 becomes an element of the pod 303. Movement provided to the main pod body 304 is directly and equally transferred to the punch shell 328. Bolts 332 are provided to attach the punch shell 328 to the main body 304. The punch shell 328 includes an annular contacting surface for contacting the metal sheet to be formed and an elongated circumferential sidewall defining a void.

A circumferential upper pressure sleeve 336 may be located radially inwardly of the punch shell 328 and within the punch shell void. An upper portion of the pressure sleeve 336 is located within an air chamber in fluid communication with a bore 342 to allow venting of fluid pressure during the downstroke. The upper portion of the pressure sleeve 336 includes an engagement ring 344 which receives a force provided from the main pod body 304 during the downstroke to impart similar movement to the sleeve 336. The pressure sleeve 336, like the punch shell 328, includes an annular contacting surface for contacting the metal sheet to be formed and an elongated circumferential sidewall defining a void.

A circumferential punch core ring or clamp piston 348 may be located radially inwardly of the upper pressure sleeve 336. The punch core ring 348 surrounds the punch core 214. The punch core ring 348, like the sleeve 336 and the shell 328, includes an annular contacting surface for contacting the metal sheet to be formed and an elongated circumferential sidewall, though shorter than either the sleeve sidewall or the shell sidewall, defining a void. The punch core 214 is located within the void.

Figure 4:
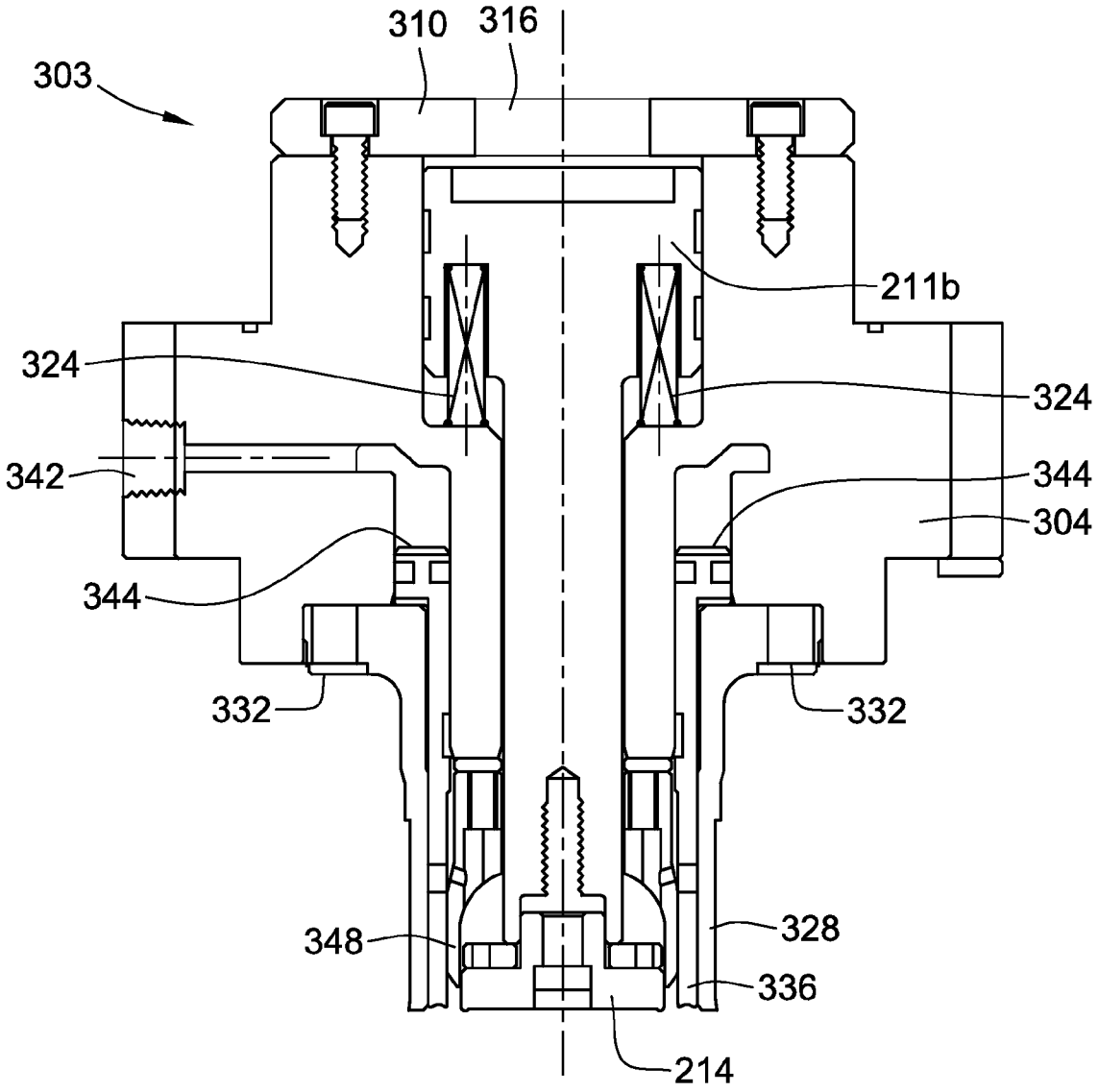
FIG. 4 is an elevational view of a tooling pod removed from the double action press of FIG. 2.

Referring to FIG. 4, accordingly, the double action press removable tooling pod 303 comprises the main pod body 304, elements of the inner tooling assembly housed within or retained to the main body 304, i.e. preferably the lower segment 211*b* of the stem or the lower punch core riser and the punch core 214, and the outer tooling assembly also housed within and or retained to the main body, i.e. preferably a first cylindrical tool 328, a second cylindrical tool 336, and a third circumferential tool 348. This tooling arrangement is particularly well adapted for forming complex, technically advanced can ends that are becoming more prevalent in the market today.

For example, as illustrated in FIGS. 5-10, the double action press with tooling pod of the present invention can be used to form a complex three-legged fold. This fold is described in commonly owned U.S. application Ser. No. 10/846,259, published as U.S. Patent Application Publication No. 2005/0006388 A1, and its related applications and issued patents. Patent Application Publication No. 2005/0006388 A1 is hereby incorporated by reference as if fully set forth herein.

FIGS. 5-10 illustrate a double-action can end shell forming operation of the present invention. The press includes an inner and an outer slide or ram having two different stroke lengths. The stroke length of the outer slide is approximately 2.5 ins. (63.5 mm). The stroke length of the inner slide in approximately 4 ins. (101.6 mm). The phase angle is approximately 25 degrees. The stroke and phase angle may differ depending on forming requirements and other manufacturing variables. In this operation, a cut edge metal blank is formed into a can end shell having a fold portion. The shell is subsequently transferred to a conversion press for further forming.

Figure 5:
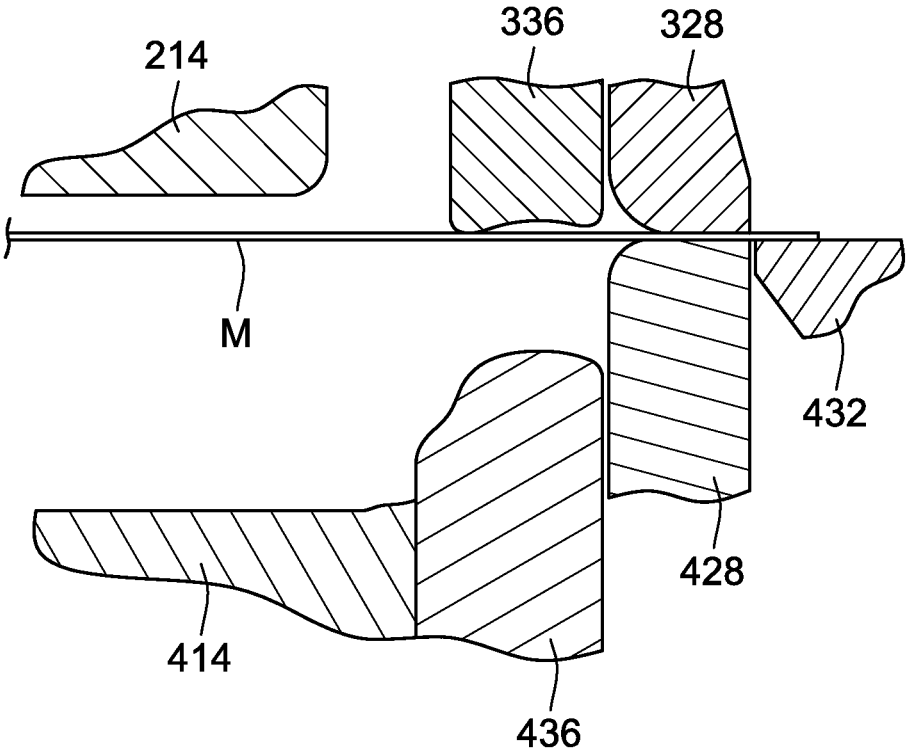
FIG. 5 is a side view of the tooling of a double action press in a first stage of forming a can end having a tri-fold.

FIG. 5 illustrates the initial step in the shell forming process. In this step, a cut edge metal blank M is provided. Upper and lower tooling are provided for forming the shell from the cut edge blank M. The upper tooling comprises the upper punch shell 328, the upper pressure sleeve 336; the punch core ring 348, the punch core 214. The lower tooling comprises a lower piston or pressure sleeve 428, the lower die core ring 436, and the panel punch 414. A blanking tool 432 is located radially outwardly of the outermost lower tool 328

As shown in FIG. 5, in a first stage, a peripheral edge of the blank M is held by an outer ring formed by the upper and lower radially outermost tools 328, 428.

Figure 6:
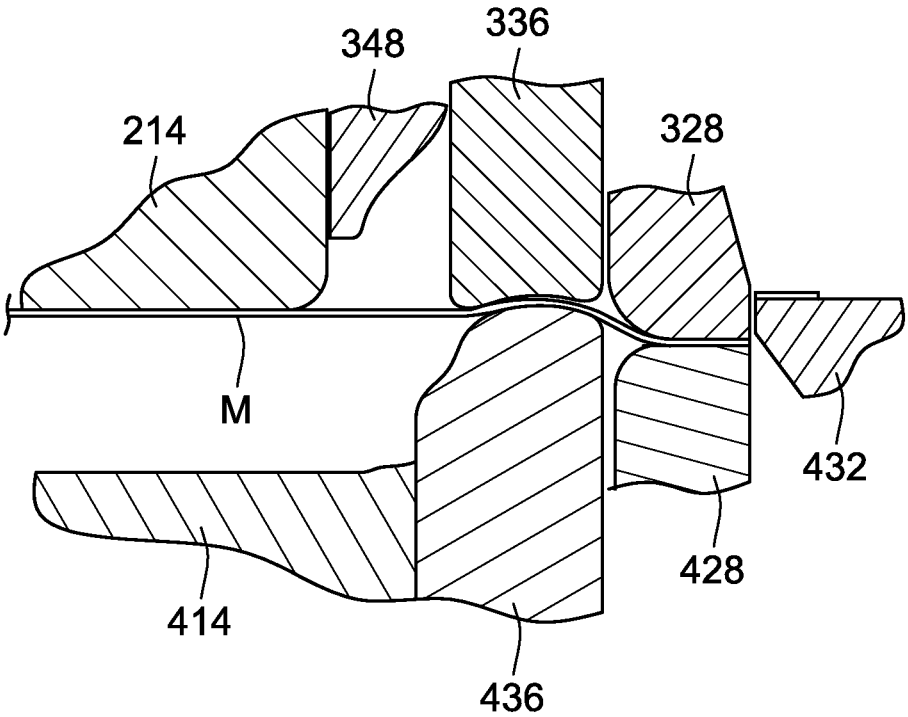
FIG. 6 is a side view of the tooling of a double action press in a second stage of forming a can end having a tri-fold.

As shown in FIG. 6, relative movement between the upper and lower tooling causes the blank M to be sheared by the blanking tool 432. A portion of the blank M wraps around an outwardly convex arcuate section of the lower die core ring 436. The first upper pressure sleeve 336 has an outwardly concave portion for pinching the blank M against the outwardly convex arcuate portion of the lower die core ring 436.

Figure 7:
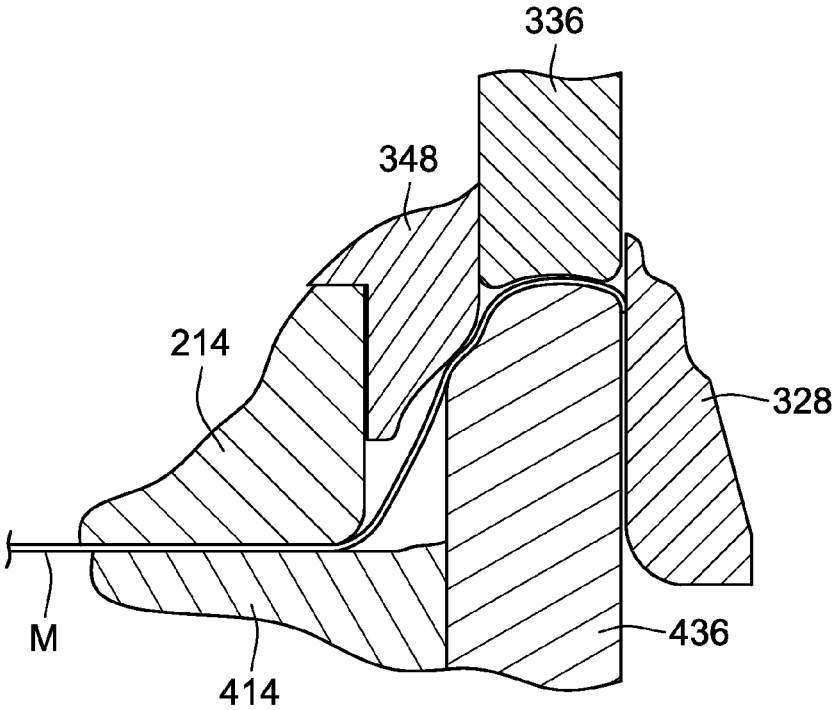
FIG. 7 is a side view of the tooling of a double action press in a third stage of forming a can end having a tri-fold.

As shown in FIG. 7, relative movement between the punch core 214 and the panel punch 414 forms a cup in the blank M as the outer peripheral edge of the blank M is retained between the upper and lower pressure sleeves 336, 436. The radially innermost lower tool 414 is kept under pressure to upwardly bias the tool 414. The pressure biasing the innermost lower tool 414 keeps the tool 414 held firmly against the product side of the shell to prevent the fold portion from unraveling during the forming process. Further, relative movement between the punch core ring 348 and the lower tooling begins to form a chuck wall radially inwardly of the outer peripheral edge of the blank M.

Figure 8:
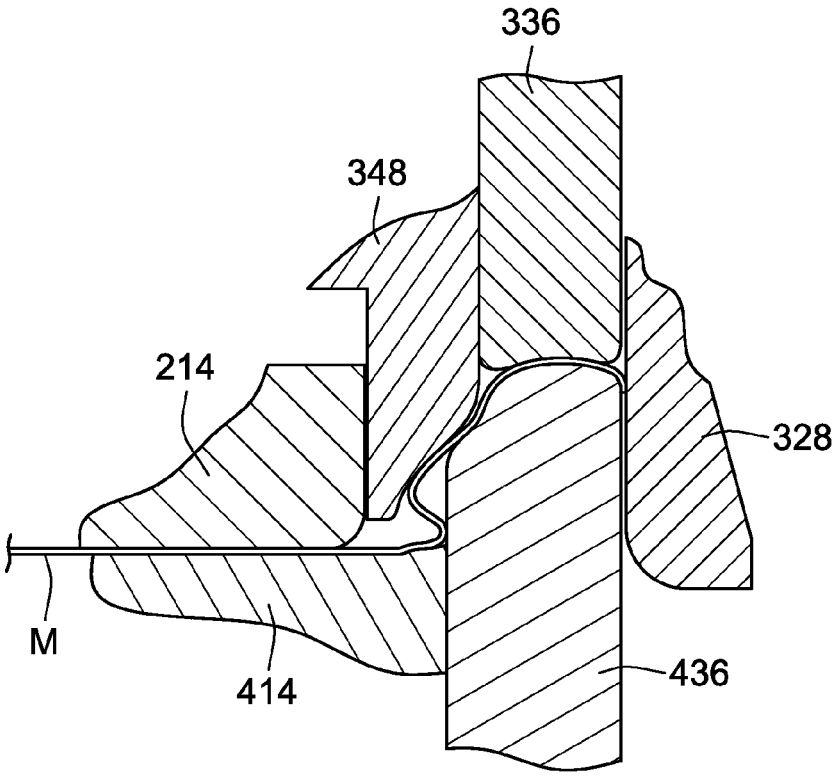
FIG. 8 is a side view of the tooling of a double action press in a fourth stage of forming a can end having a tri-fold.

The forming continues as illustrated in FIG. 8. A circumferential portion of the blank M free forms between the punch core ring 348 and the lower pressure sleeve 436. The fold portion begins to form in this sequence.

Figure 9:
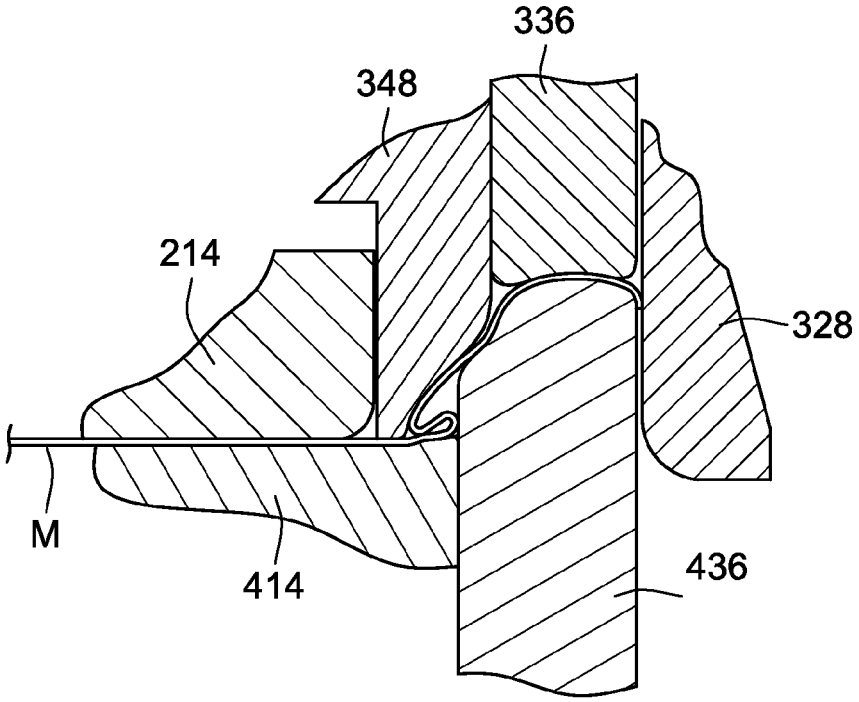
FIG. 9 is a side view of the tooling of a double action press in a fifth stage of forming a can end having a tri-fold.

FIG. 9 shows the upper and lower tooling in their fully traversed positions. The fold is fully formed between the chuck wall and the central panel, and the seaming curl is partially formed.

Figure 10:
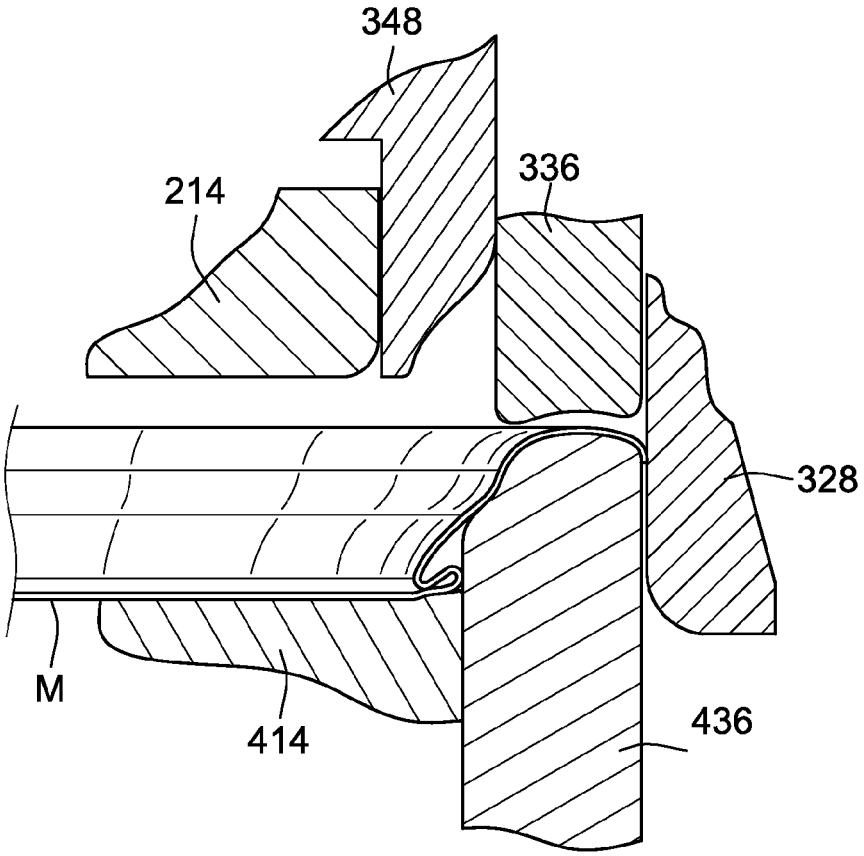
FIG. 10 is a side view of the tooling of a double action press in a sixth stage of forming a can end having a tri-fold.

In FIG. 10, the upper and lower tooling is retracted. The can end shell is fully formed.

The apparatus of the present invention solves a long felt but unresolved need of the prior art, namely providing a more accurate and efficient method to tram and align tooling in a double action press for forming can end shells. None of the known double action presses of this type combine a tooling pod with a two-part inner and outer riser system to address the tramming difficulty. Furthermore, the double action press disclosed herein also provides the unexpected result of reducing the number of seals and reducing the operation temperature of the press. In time, the applicants expect the can making industry to adopt many of the improvements described herein.

While the specific embodiments have been illustrated and described, numerous modifications come to mind without significantly departing from the spirit of the invention, and the scope of protection is only limited by the scope of the accompanying Claims.

What is claimed is:

1. An apparatus for forming a beverage can lid, the apparatus comprising:

a longitudinal axis; and an upper tooling assembly separated from a lower tooling assembly such that a metal blank may be deformed therebetween, the upper tooling assembly comprising:

an inner tooling assembly positioned about the longitudinal axis comprising a downwardly extending stem comprising an upper segment having a lower free end and a separate lower segment having a proximal end in operative communication with, but not joined to, the lower free end of the upper segment and an opposing distal end joined to a punch core tool; and an outer tooling assembly positioned about the longitudinal axis and having a passageway through which a portion of the stem passes, a chamber in which the proximal end of the lower segment of the stem resides and traverses upwardly and downwardly therein, a biasing means associated with the chamber for biasing the lower segment of the stem in an upward position, and a circumferential tooling set comprising a tool having an annular contacting surface and a void defined by an elongated circumferential sidewall, another tool located radially inwardly of the annular contacting surface of the tool and within the void defined by the inner surface of the elongated circumferential sidewall of the tool.

2. The apparatus of claim 1 wherein the chamber has a cross-sectional area greater than a cross-sectional area of the passageway located directly below the chamber.

3. The apparatus of claim 2 further comprising:

an inner tooling assembly drive mechanism in operative communication with the inner tooling assembly for imparting a downward force to thereto.

4. The apparatus of claim 3 wherein the lower segment of the stem and the punch core tool form a removable tooling pod with the circumferential tooling set of the outer tooling assembly and wherein the tooling pod is removable from the apparatus as a single unit.

* * * * *